United States Patent [19]

Inabata

[11] Patent Number: 5,032,035

[45] Date of Patent: Jul. 16, 1991

[54] PLATEN ROLL CORE

[75] Inventor: Tadao Inabata, Tokyo, Japan

[73] Assignee: Inabata Techno Loop Corporation, Tokyo, Japan

[21] Appl. No.: 298,349

[22] Filed: Jan. 17, 1989

[30] Foreign Application Priority Data

Jan. 20, 1988 [JP] Japan ..... 63-8492

[51] Int. Cl.[5] ..... B41J 11/02

[52] U.S. Cl. ..... 400/661; 400/661.3; 29/130; 181/196

[58] Field of Search ..... 400/661, 661.3, 661.1, 400/661.2; 29/125, 130–132; 181/196–197

[56] References Cited

U.S. PATENT DOCUMENTS

| | | | |
|---|---|---|---|
| 1,181,959 | 5/1916 | Roberts | 400/661.3 |
| 1,235,753 | 8/1917 | Anderson | 400/661.3 |
| 2,142,260 | 1/1939 | Thompson | 400/661.3 |
| 3,812,782 | 5/1974 | Funahashi | 29/130 |
| 4,215,946 | 8/1980 | Nakabo et al. | 400/661.3 |
| 4,453,848 | 6/1984 | Adkisson | 400/661 |

FOREIGN PATENT DOCUMENTS

| | | | |
|---|---|---|---|
| 686615 | 5/1964 | Canada | 400/661 |
| 208039 | 1/1987 | European Pat. Off. | 400/661 |
| 55265 | 4/1983 | Japan | 400/661 |
| 222870 | 12/1983 | Japan | 400/661 |
| 230877 | 11/1985 | Japan | 400/661 |
| 71670 | 4/1987 | Japan | 400/661.1 |
| 466209 | 5/1937 | United Kingdom | 400/661.3 |

*Primary Examiner*—Eugene H. Eickholt

*Attorney, Agent, or Firm*—Lowe, Price, LeBlanc & Becker

[57] ABSTRACT

A platen roll core has a plurality of roll elements, and spacers interposed between adjacent roll elements of attenuation of propagated vibrations. The core, seen in terms of vibrating system, is equivalent to the sum of vibrating systems independent of one another and corresponding to the respective roll elements. The axial length of each roll element is set to such a value that the natural frequency thereof in an axial flexural oscillation mode is greater than a frequency of vibration applied from a vibration source, to thereby avoid the resonance of the core in the axial flexural oscillation made with the vibration source, such resonance being a main cause of an increase in noise level.

19 Claims, 5 Drawing Sheets

PLATEN ROLL CORE

FIELD OF THE INVENTION

The present invention relates to a platen roll core which is mounted to a printer, typewriter or the like and is prevented from resonating with a vibration source.

BACKGROUND OF THE PRIOR ART

It is desirable that platen rolls which are light in weight and low in noise level during use should be used in printers etc. A lightweight platen roll core is known in which, for example, a shaft portion which is to be coupled to the drive shaft of a rubber platen is coupled, by means of ribs, to a cylinder portion on which a platen is to be fitted, such that cavities are defined between the shaft portion and the cylinder portion. The core of this type, however, resonates with sound waves produced during printing to cause air-column vibrations in the cavities and, therefore, produces undesirable noises. To reduce such noises, Japanese Utility Model Disclosure No. 60-166551, for example, discloses forming of ridges which protrude toward the cavities so that the sound waves produced by vibrations are irregularly reflected by the ridges and are canceled out.

However, the regulations on noise levels of printers, etc., tend to become more and more strict, further, and improvement of the sound-damping qualities is desirable.

SUMMARY OF THE INVENTION

The principal object of the present invention is to provide a platen roll core which is prevented from resonating with a vibration source and therefore is low in noise level generated during use.

SUMMARY OF THE INVENTION

A platen roll core according to the present invention comprises: at least two roll elements each having such an axial length such that a natural frequency thereof in an axial flexural oscillation mode is greater than a frequency of vibration applied to said platen roll core from a vibration source; and at least one spacer interposed between adjacent ones of the at least two roll elements, for attenuating propagated vibrations.

According to the invention, the platen roll core, which has a plurality of roll elements and a spacer interposed between adjacent roll elements for attenuation of propagated vibrations and which, as a whole, constitutes one vibrating system, is divided into a plurality of vibrating systems. In other words, the core as a vibrating system is equivalent to the sum of independent vibrating systems corresponding to the respective roll elements. The natural frequency of each core element in an axial flexural oscillation mode is thus set to be greater than a frequency of vibration applied to the platen roll core from a vibration source. The platen roll core of the invention is advantageous in that the resonance of the core in the axial flexural oscillation mode with a vibration source, which is a main cause of an increase in noise level, is avoided and therefore the core is low in noise level in use.

DETAILED DESCRIPTION

The principles of vibrations of a cylindrical platen roll will be briefly explained before proceeding to a description of a platen roll core according to the present invention.

A platen roll, when subjected to a wideband vibration whose fundamental frequency is equal to the printing frequency is set in resonance if its natural resonance frequency as determined by the physical properties thereof, such as material, dimensions, etc., coincides with the frequency of a vibration applied to the platen roll from a vibration source (hereinafter referred to as the vibrating frequency). The platen roll has different resonance frequencies with respect to different oscillation modes.

More specifically, vibrations of the platen roll comprise mechanical vibrations of the platen roll itself, and vibrations of air columns produced within the cavities of the platen roll.

Figure 3A:
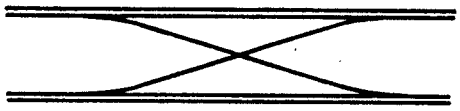
FIGS. 3A to 3C are diagrams illustrating vibrations of air columns in an axial mode, produced within a platen roll.
Figure 3B:
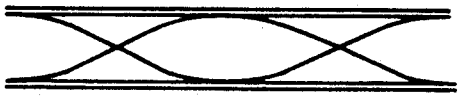
Figure 3C:
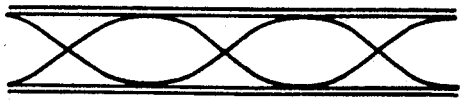
Figures 4A, 4B, 4C, 4D, 5A, 5B, 5C, 6A, 6B, 6C:
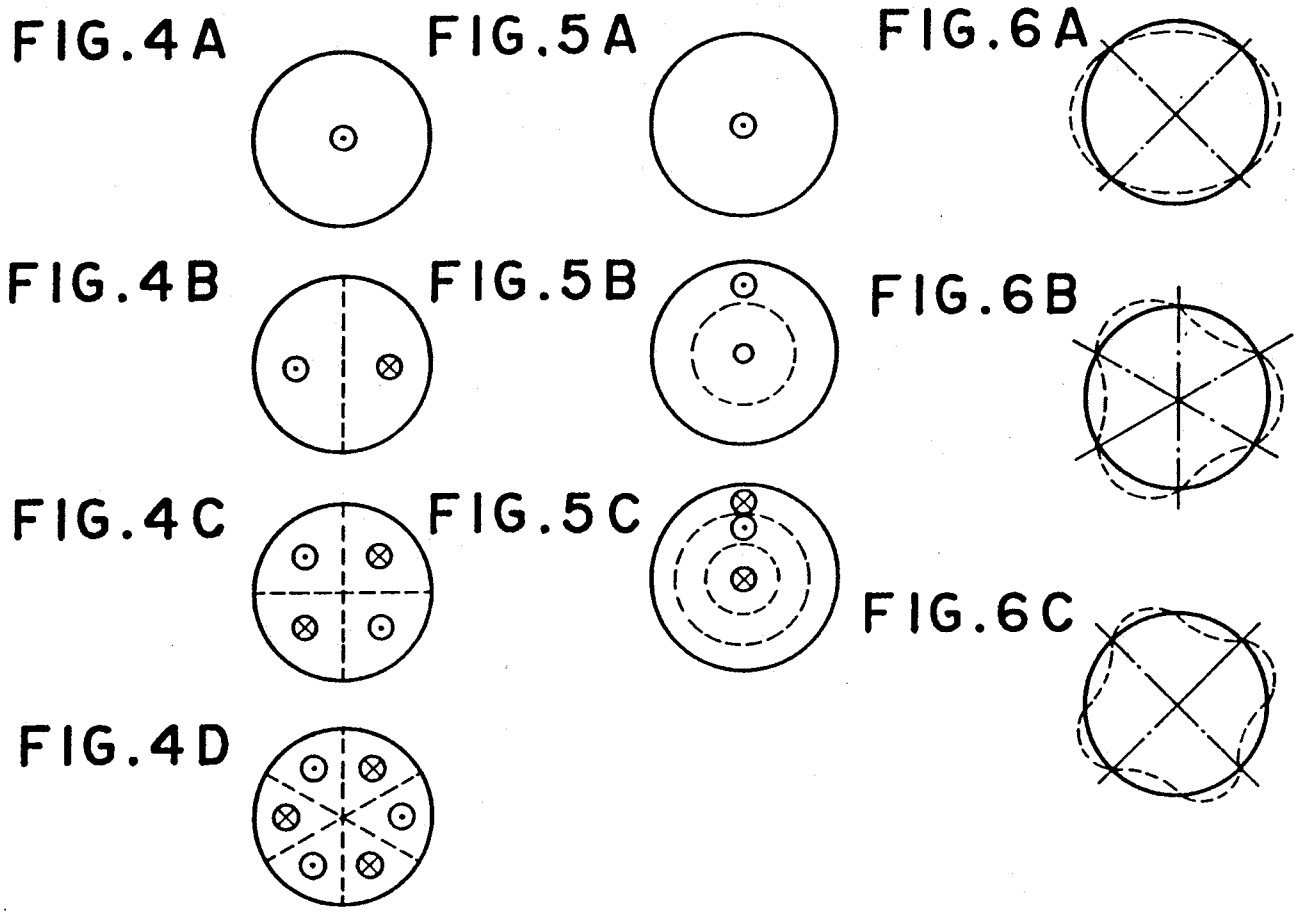
FIGS. 4A to 4D are diagrams illustrating vibrations of air columns in a radial node mode.
FIGS. 5A to 5C are diagrams illustrating vibrations of air columns in a circular node mode.
FIGS. 6A to 6C are diagrams illustrating mechanical vibrations of a platen roll in an annular oscillation mode.

The air-column vibrations include an axial mode vibration (FIG. 3), a radial node mode vibration (FIG. 4), and a circular node mode vibration (FIG. 5).

The axial mode vibration includes longitudinal vibrations the wavelengths of which are equal to $2/n$ ($n=1, 2, 3, \ldots$) times the axial length of the platen roll. The radial node mode vibration and circular node mode vibration are the vibrations which include a fundamental vibration whose vibrational direction is the same over the entire circular cross-sectional plane of the platen roll, and harmonic vibrations whose vibrational directions are opposite in adjacent sectoral areas and annular areas of the circular cross-sectional plane of the roll, respectively.

Figure 7:
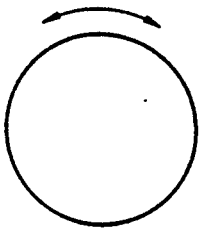
FIG. 7 is a diagram illustrating a mechanical vibration in a torsional mode.
Figure 8A:
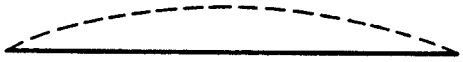
FIGS. 8A to 8C are diagrams illustrating mechanical vibrations in an axial flexural oscillation mode.
Figure 8B:
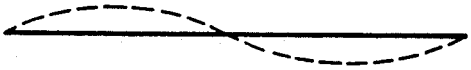
Figure 8C:
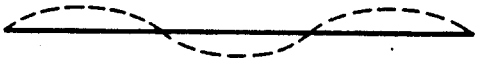

The mechanical vibrations include various vibrations in an annular oscillation mode (FIG. 6) whose nodes are located equidistantly in the circumferential direction of the platen roll, vibrations in a torsional oscillation mode (FIG. 7) which are produced about the axis of the platen roll, and flexural vibrations in an axial flexural oscillation mode (FIG. 8) whose wavelengths are equal to $2/n$ times the axial length of the platen roll.

Figure 9:
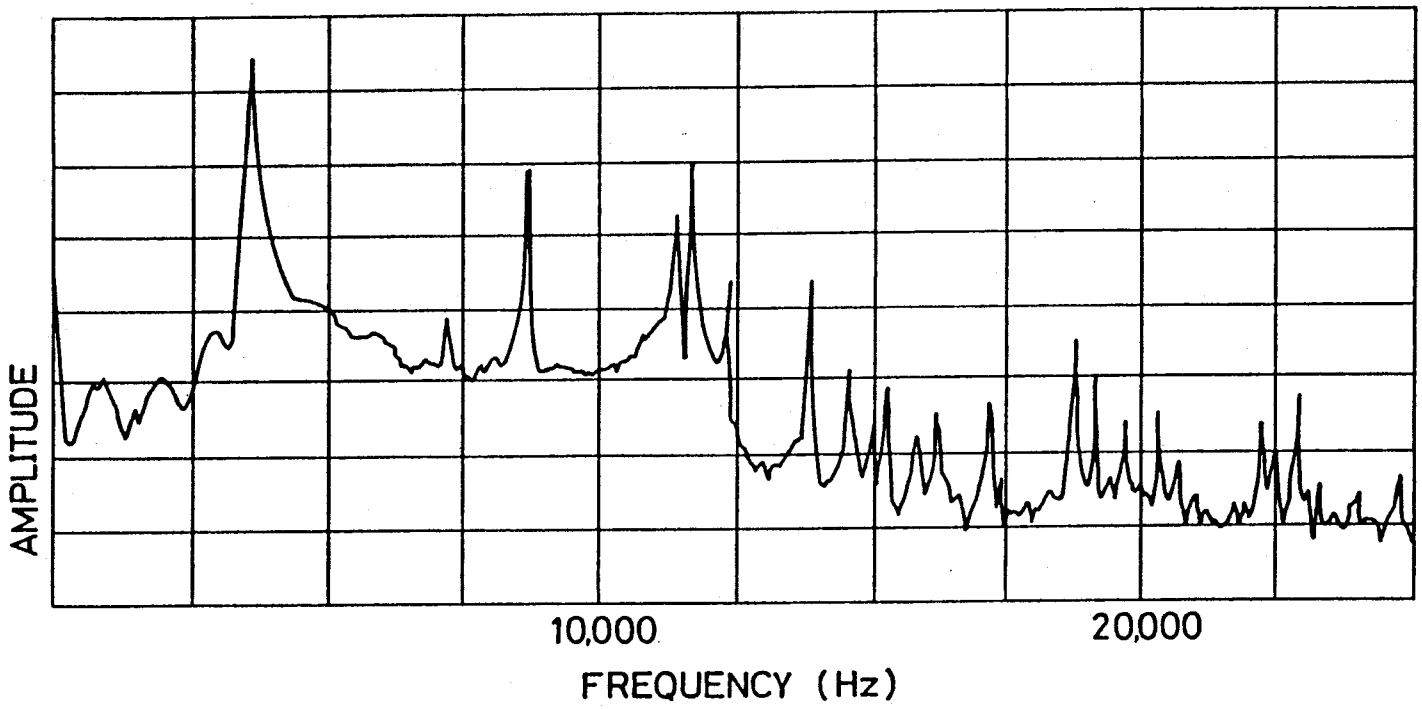
FIG. 9 is a graph showing the amplitude-frequency characteristic of a platen roll core having an axial length of 200 mm.
Figure 10:
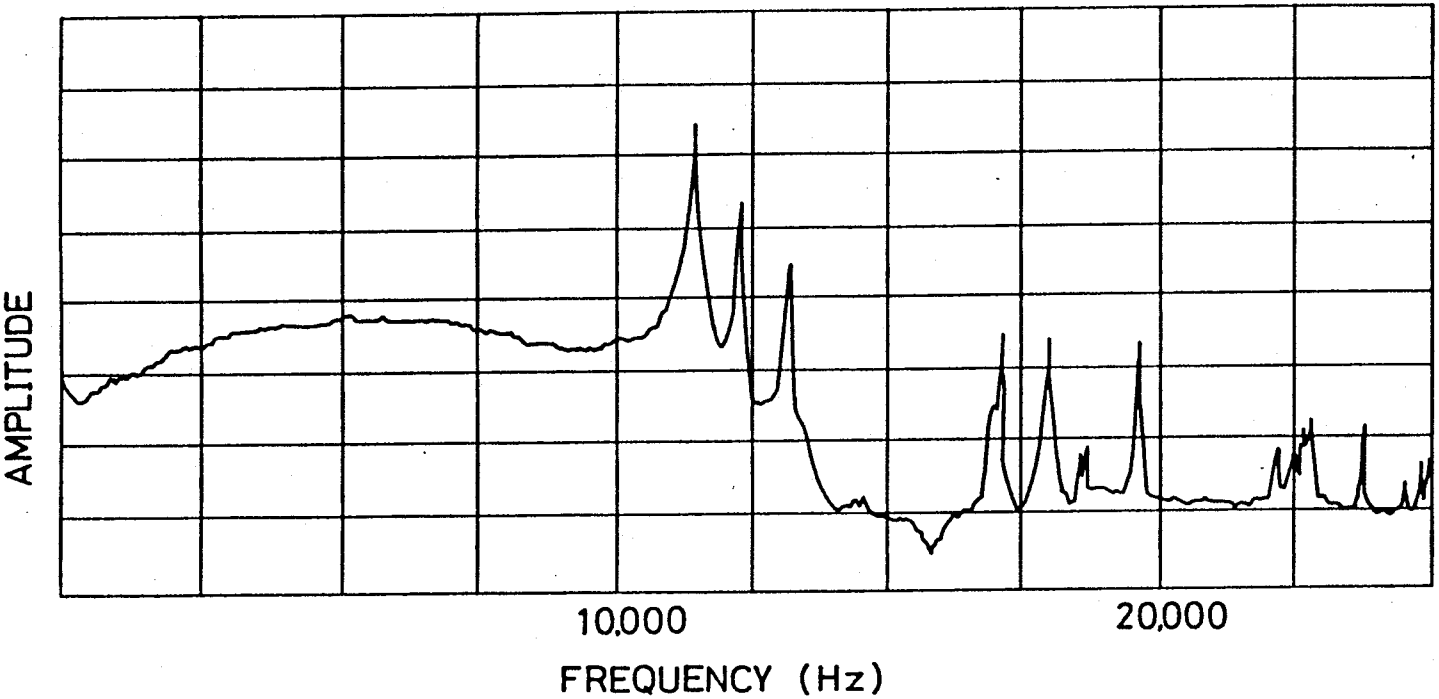
FIG. 10 is a graph similar to FIG. 9, but showing the characteristic of a core with an axial length of 100 mm.

A first principle employed in the present invention for prevention of resonance is that the platen roll core, constituting a single vibrating system, is divided into a plurality of independent vibrating systems which correspond respectively to roll elements coupled to each other by a spacer for vibration attenuation, such a core can resonate chiefly with frequencies equal to the natural frequencies of the respective roll elements. A second principle is that the roll elements individually constituting independent vibrating systems have their axial lengths set to such small values that their natural frequencies of axial flexural oscillation may be smaller than the vibrating frequency. In this respect, the amplitude-frequency characteristics were experimentally measured for roll elements of a later-mentioned type having various axial lengths, part of the results being shown in FIGS. 9 and 10. It was found that core elements with axial lengths of 500 mm, 400 mm, 300 mm and 200 mm resonated within the vibrating frequency range of an ordinary printer, and that a core element with an axial length of 100 mm did not resonate within a frequency range not higher than 10,000 Hz. FIGS. 9 and 10 respectively show the characteristics of core elements having axial lengths of 200 mm and 100 mm. As will be noted, by dividing the core into a plurality of roll elements of suitable lengths, and by preventing each roll element from resonating with the vibration source, the core can be prevented from resonating with the vibrating source in axial flexural oscillation which is a main cause of increase in noise level.

Preferably, in the present invention, the resonance of the core resulting from air-column vibrations in the axial mode can also be avoided. The principle involved is that the cavity of the core is divided into a plurality of parts each having a frequency of air-column vibration greater than the vibrating frequency. This principle is realized by separating the cavities of adjacent roll elements from each other by means of a spacer, and by setting the axial length of each roll element such that the frequency of the air-column vibration in the axial mode produced in each cavity may be greater than the vibrating frequency.

Figure 1:
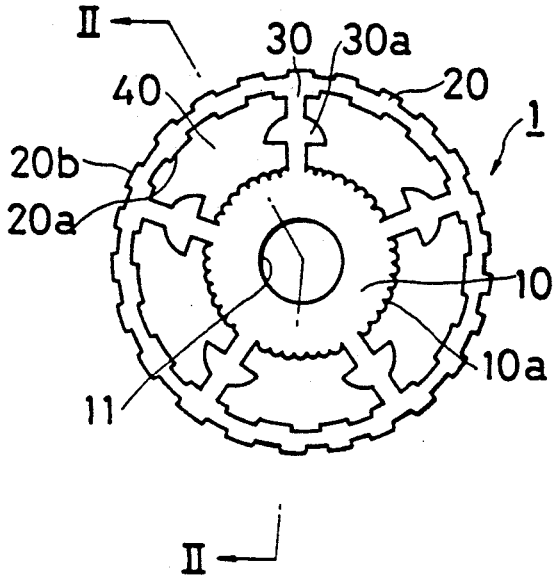
FIG. 1 is a cross-sectional view of a platen roll core according to a preferred embodiment of the present invention.
Figure 2:
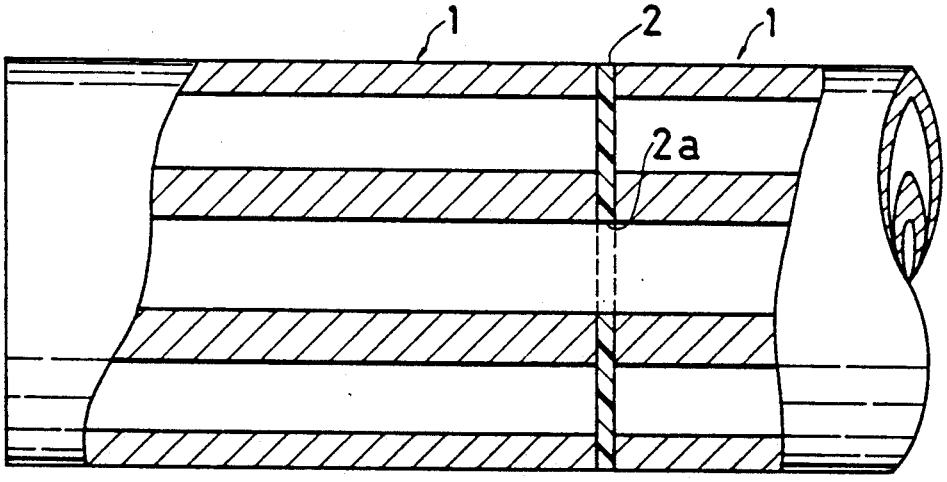
FIG. 2 is a front view, partly in section, of the core shown in FIG. 1.

A platen roll core for use in a dot matrix printer, according to an embodiment of the present invention, will now be described with reference to FIGS. 1 and 2.

A platen roll core comprises a desired number, e.g., 5, of roll elements (some of which are denoted by reference numeral 1), and spacers 2 each interposed between adjacent roll elements 1, the roll elements 1 and spacer 2 being joined to each other. The roll elements 1 have a substantially identical structure and comprise a shaft portion 10 and a cylinder portion 20 coupled together by means of a predetermined number of, preferably, five ribs 30. The roll elements are obtained by molding an aluminum light alloy, e.g., through integral extrusion; for The ribs 30 each extend radially of the axis of the core between the shaft portion 10 and the cylinder portion 20 disposed concentrically with the shaft portion 10, and define cavities 40 in cooperation with the shaft portion 10 and the cylinder portion 20. These ribs 30 are preferably situated at irregular angular intervals around the axis of the core.

The five roll elements 1 have a predetermined axial length, e.g., approximately 80 mm, so that they resonate neither in the axial flexural oscillation mode nor in the axial air-column oscillation mode with a printing mechanism (not shown) as a vibration source in the frequency range of vibrations produced by the printing action. Preferably, the five roll elements have axial lengths slightly different from one another, for example, 79–83 mm set in units of 1 mm. The axial lengths of the platen roll and the roll elements are selected such that the ratio of the axial length of the platen roll to that of the respective roll element and the ratio of the axial length of any one of the roll elements to those of the other roll elements have values other than integral numbers.

Figure 11:
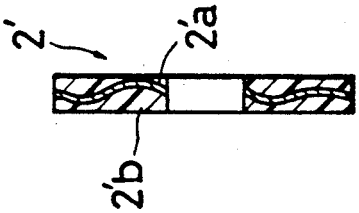
FIG. 11 is a sectional view schematically illustrating a modification of a spacer.

The spacers 2, which serve to attenuate the vibrations propagated between adjacent roll elements 1, are made of a material having a rigidity different from that of the material of which the roll elements 1 are made. For example, in the case where the roll elements 1 are made of aluminum, the spacers 2 are made of synthetic resin, rubber, or the like. The spacers 2, which have a different rigidity from the roll elements 1, have a predetermined thickness set in accordance with the difference in rigidity between the spacers 2 and the roll elements 1, such that adjacent roll elements 1 constitute separate vibrating systems and are isolated from each other in terms of vibration. The spacers 2 of this embodiment are each in the form of a disc having a shaft hole **2*a*. Where the spacers are made of flexible resin, rubber or the like, the roll may be deformed during the surface finish process of the platen roll and therefore may not be finished with high precision. In such cases, spacers 2', each composed of a resin disc 2'*b* and a thin corrugated plate 2'*a* with a thickness of about 0.1 mm, which is made of a vibration-damping metal with a large rigidity and embedded in the disc 2'*b* as shown in FIG. 11, may be used. The spacers 2'** have both a flexure preventing function and a vibration damping function.

A shaft for driving the platen (not shown) which is made of a material having a different rigidity from the materials of which the elements of the core are made, e.g., iron, is fitted through the shaft holes 11 of the roll elements 1 formed along the axes of the respective shaft portions 10, and through the shaft holes **2*a* of the spacers. The shaft extends through the entire length of the core composed of the five roll elements 1 arranged in alignment and along the axis of the core. A hollow cylindrical cover member (not shown), which is made of rubber or the like, is fitted around the cylinder portions 20 of the roll elements 1. Moreover, the shaft portion 10, cylinder portion 20 and ribs 30 of each roll element 1 have respective ridges or protrusions which serve to irregularly reflect the propagated sound waves and vary the vibration propagation areas so as to reduce printing noises. More specifically, parallel ridges 10*a* each having a semicircular cross-section are formed on the outer peripheral surface of the shaft portion 10 in the axial direction of the core. Ridges 20*a* and 20*b*, having rectangular and trapezoidal cross-sections, respectively, are formed on the inner and outer peripheral surfaces of the cylinder portion 20, respectively. Further, ridges 30*a* having a quadrantal cross section are formed on both side surfaces of each rib 30**.

The operation of the platen roll core according to this embodiment will now be described.

During a printing operation of a printer, the sound waves produced by printing action are propagated to the platen roll core via the cover member (not shown). At this time, in general, a core, which has specific resonance frequencies corresponding to the above-mentioned various oscillation modes and determined by the physical properties of the core, is resonated to produce noises when the frequencies of the propagated vibrations coincide with any of the resonance frequencies.

In this embodiment, adjacent roll elements 1 are separated in terms of vibration from each other by means of the spacer 2 interposed between the elements 1. Each roll element 1 can therefore resonate in the axial flexural oscillation mode with a vibrating frequency equal to its natural frequency which is determined by its axial length. However, since the axial length of each roll element 1 is set such that the roll element can resonate only with a frequency higher than the vibrating frequency, resonance of the roll elements are not caused by the printing action. Furthermore, the core as a whole is constructed so as to be capable of resonating substantially only in the point of resonance of each roll element 1, whereby no resonance of the core in the axial flexural mode occurs.

As for the air-column vibration in the radial node mode and the mechanical vibration in the annular oscillation mode, if the ribs are situated at circumferentially equal intervals, resonance of the core occurs since the conditions of generating low-order air-column vibrations and mechanical vibrations are fulfilled. In the preferred embodiment, however, the ribs 30 are not arranged equidistantly in the circumferential direction. Therefore, not only vibrations of low order but also those of considerably high order can be avoided in both the radial node mode and the annular oscillation mode since the conditions for generating such vibrations are not satisfied. Moreover, since five ribs are used, the conditions for generating low-order vibrations in the radial node mode and the annular oscillation mode are more rarely fulfilled than in the case of using two, three or six ribs. Thus, the use of five ribs, in cooperation of its circumferentially irregular arrangement, serves to reliably avoid vibrations of the core in these modes. Still further, as vibrations are propagated through the shaft portions 10, cylinder portions 20, ribs 30 and cavities 40, they are attenuated due to the irregular reflection function and the propagation area varying function provided by the ridges 10*a*, 20*a*, 20*b* and 30*a* formed on the members 10, 20 and 30. As a result, propagated vibrations, particularly low-order frequency components or audio frequency components contained therein, are attenuated, whereby noises produced in the platen roll core during printing can be reduced.

The present invention is not limited to the above-described embodiment and various modifications are possible. For example, a multiplicity of small through-holes may be formed in the thickness direction of the spacers 2 or 2' over the entire area thereof. In this case, when air-column vibrations take place in the cavities, air passes through the small holes so that the vibrational energy is converted into thermal energy, thus reducing noises. For the same purpose, the spacers 2 may be made of porous ceramics, metal, macromolecular fiber net, or the like. Furthermore, although the above embodiment uses a platen drive shaft which extends over the entire length of the platen roll core, shafts may be press-fitted into the outer ends of the roll elements situated on the opposite ends of the core.

Further, in the preferred embodiment, the roll elements are of the type having a shaft portion and a cylinder portion coupled together by ribs. The roll elements, however, are not limited to this type alone, but roll elements of a cylindrical shape may alternatively be used. Moreover, the core may alternatively be formed as follows: preparing hollow cylindrical members of synthetic resin by means of injection molding, each of which corresponds to both the cylinder portion of the roll element and the spacer in the above embodiment and which has one end closed but a shaft hole; fitting a molded member, corresponding to the ribs and the shaft portion of the roll element of the embodiment, into each hollow cylindrical member to provide a core component (not shown); and by joining a desired number of core components together, thereby obtaining a core. Still further, the exact method of forming the core, i.e., integral molding through extrusion, is not essential to the present invention. In the foregoing embodiment, the five ribs are arranged at circumferentially irregular intervals. The number of ribs, however, is not limited to five, and the ribs may be arranged circumferentially equidistantly. Further, the dimensions, shapes and materials of the elements forming the core may be changed as needed.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A platen roll core, comprising:

at least two roll elements comprising a first material and disposed lengthwise adjacently on an axis of a common shaft, each having a predetermined individual axial length such that a natural frequency thereof in an axial flexural oscillation mode is different from an expected predetermined frequency of vibration applied to said platen roll core from a vibration source during use of the platen roll core; and at least one spacer comprising a second material and interposed between adjacent ends of said at least two roll elements, for attenuating any vibrations propagated therethrough, said spacer being supported by said common shaft, wherein a first ratio, formed by dividing the length of the platen roll core by the length of a roll core element, is a non-integer value for any of said at least two roll elements.

2. The platen roll core according to claim 1, wherein:

the at least two elongate roll elements have substantially the same cross-sectional structure comprising a shaft portion and a concentric outer cylindrical portion coupled by radially extending ribs therebetween, whereby cavities are defined between said ribs within the cylindrical portion.

3. The platen roll core according to claim 2, wherein:

said ribs are radially disposed at irregular angular positions about an axis of the shaft portion.

4. The platen roll core according to claim 1, wherein:

a second ratio, formed by dividing the length of a first roll element by the length of a second roll element is a non-integer value for any such first and second roll elements selected from said at least two roll elements.

5. The platen roll core according to claim 1, wherein:

said first material comprises integrally extruded aluminum alloy.

6. The platen roll core according to claim 1, wherein:

said second material comprises a flexible material.

7. The platen roll core according to claim 6, wherein:

said second material comprises one of a flexible resin and rubber.

8. The platen roll core according to claim 1, wherein:

an axially disposed shaft, comprising a third material having a different rigidity from that of said first and second materials, extending through all of said elongate roll elements and spacers disposed therebetween.

9. The platen roll core according to claim 1, wherein:

said shaft portion, said cylinder portion and said rib portion of each element are formed to each have protrusions inside said cavities, whereby any sound waves propagated in the cavities are irregularly reflected.

10. The platen roll core according to claim 9, wherein:

said protrusions on a surface of said shaft portion comprise a plurality of parallel ridges, of substantially semicircular cross-section, oriented in an axial direction.

11. The platen roll core according to claim 9, wherein:

said protrusions on said ribs are formed on both sides thereof as ridges having a quadrantal cross-section.

12. The platen roll core according to claim 1, wherein:

outer peripheral surfaces of said at least two roll elements and said spacer therebetween are covered by a common outer layer.

13. The platen roll core according to claim 1, wherein:

said first and second materials have different rigidities.

14. The platen roll core according to claim 1, wherein:

said spacer is provided with a plurality of small through-holes, whereby air can pass from one side of said spacer to the opposite side thereof and convert vibrational energy to thermal energy to reduce noise.

15. The platen roll core according to claim 1, further comprising:

shaft elements press-fitted to the longitudinally outermost ends of said roll elements.

16. The platen roll core according to claim 1, wherein:

the number of said ribs is an odd number.

17. A platen roll core, comprising:

at least two roll elements comprising a first material and disposed lengthwise adjacently on an axis of a common shaft, each having a predetermined individual axial length such that a natural frequency thereof in an axial flexural oscillation mode is different from an expected predetermined frequency of vibration applied to said platen roll core from a vibration source during use of the platen roll core; and at least one spacer comprising a second material and interposed between adjacent ends of said at least two roll elements, for attenuating any vibrations propagated therethrough, said spacer being supported by said common shaft, wherein said spacer comprises a flat disc made of resin and a thin corrugated plate, comprising a vibration-damping metal, embedded therein.

18. The platen roll core according to claim 17, wherein:

said vibration-damping metal has a high rigidity.

19. A platen roll core, comprising:

at least two roll elements comprising a first material and disposed lengthwise adjacently on an axis of a common shaft, each having a predetermined individual axial length such that a natural frequency thereof in an axial flexural oscillation mode is different from an expected predetermined frequency of vibration applied to said platen roll core from a vibration source during use of the platen roll core; and at least one spacer comprising a second material and interposed between adjacent ends of said at least two roll elements, for attenuating any vibrations propagated therethrough, said spacer being supported by said common shaft, said roll elements being formed to each have a cavity, and said spacer separates the cavities of adjacent roll elements from each other, said shaft portion, said cylinder portion and said rib portion of each element being formed to each have protrusions inside said cavities, whereby any sound waves propagated in the cavities are irregularly reflected, and said protrusions on said cylindrical portion being formed as plural axially oriented parallel ridges, said ridges on an outer peripheral surface of the cylindrical portion having trapezoidal cross-sections and said ridges on an inner peripheral surface of the cylindrical portion having rectangular cross-sections.

* * * * *